US005228169A

United States Patent [19]

Stein et al.

[11] Patent Number: 5,228,169

[45] Date of Patent: Jul. 20, 1993

[54] BRUSH TYPE VACUUM CLEANER

[75] Inventors: Klaus Stein; Heinz Kaulig, both of Velbert, Fed. Rep. of Germany

[73] Assignee: Stein & Co. GmbH, Velbert, Fed. Rep. of Germany

[21] Appl. No.: 747,185

[22] Filed: Aug. 19, 1991

[30] Foreign Application Priority Data

Apr. 18, 1991 [DE] Fed. Rep. of Germany ... 9104750[U]

[51] Int. Cl.[5] ..... A47L 5/28

[52] U.S. Cl. ..... 15/351

[58] Field of Search ..... 15/350, 351

[56] References Cited

U.S. PATENT DOCUMENTS 2,672,642 3/1954 Tamarin et al. ..... 15/351
2,806,242 9/1957 Sparklin ..... 15/351
3,344,460 10/1967 Nordeen ..... 15/351
3,491,519 1/1970 Ettridge ..... 15/350 X
3,634,905 1/1972 Boyd ..... 15/350
3,675,268 7/1972 Nordeen ..... 15/350

*Primary Examiner*—Chris K. Moore
*Attorney, Agent, or Firm*—Nils H. Ljungman & Associates

[57] ABSTRACT

A brush type vacuum cleaner having a filter housing and a suction, or brush-suction, head. The filter housing is pivotally connected to the brush-suction head by a rigid guide element or rigid connector that includes two air channels for channelling air between the filter housing and the brush-suction head. The air channels include openings for connection to the suction blower of the vacuum cleaner and the vacuum mouthpiece of the brush-suction head.

8 Claims, 3 Drawing Sheets

BRUSH TYPE VACUUM CLEANER

BACKGROUND OF THE INVENTION

1. Field of the Invention

The present invention relates to an apparatus for brush-type vacuum cleaners wherein a pivoting connection between a filter housing with a handle and brush-suction head is provided by a guide element. The brush-suction head is positioned on a floor surface when the vacuum cleaner is in use. The brush-suction head includes a motor for a suction blower as well as for the drive of a cleaning brush.

2. Background Information

With the vacuum cleaner of the present invention, one motor is provided for operating the suction blower as well as the cleaning brush. The cleaning brush is driven simultaneously with the suction blower by means of additional drive devices such as drive belts. Since all of the heaviest components of the vacuum cleaner are then mounted in the brush-suction head which rolls along the ground, the hand load that the user experiences may be kept particularly low.

One proposed brush-type vacuum cleaner has a filter device whereby the dirt-laden suction air is first directed through a filter bag mounted in a filter housing before the air flows through the suction blower. However, with this device there is a problem of air conduction. Specifically, the suction air coming from the vacuum mouthpiece through the brush-suction head must be directed into the filter housing and then, via a separate route, back to the brush-suction head and the suction motor located therein.

One proposed vacuum cleaner provides a pivoting connection between the filter housing and the brush-suction head having hoses. Deficiencies have arisen in practical execution, however. Hose connections are relatively expensive and there are problems in achieving a secure and airtight seal. In addition, the hose connections are subjected to severe bending loads and abrasion wherein pointed and sharp objects in the suction air, such as needles, can damage the hoses. Furthermore, the filter housing and brush-suction head can be separated from one another only with difficulty and are, thus, difficult to handle for transport and packing.

OBJECT OF THE INVENTION

It is an object of the present invention to create an improvement to the design of vacuum cleaners, which makes possible a fixed component for air conduction and a connection for executing the pivoting motion between the brush-suction head and the filter housing and guarantees simple operation for a quick, reliable connection and separation of the elements by the user.

SUMMARY OF THE INVENTION

This object is achieved by the present invention wherein a guide element is provided that contains an air duct with two separate channels. One end of the guide element is provided as an attachment element in the form of a connection above the brush-suction head for the mounting of the filter housing. The other end of the guide element is provided as a circular element in the brush-section head and is guided so that it can pivot. An opening in the vicinity of an axis of the guide element from one of the element channels to the suction blower is provided along with another opening of the other channel of the guide element in an outer surface for connection of the guide element with a vacuum mouthpiece of the brush-suction head.

In one embodiment, of the present invention, the longitudinal axes of the separate channels may be oriented approximately parallel to one another.

In one embodiment, of the present invention, the attachment element on the brush-suction head may be a receptacle for a locking element for locking the brush suction head with the mountable filter housing.

In one embodiment of the present invention, the attachment element on the brush-suction head may be an electrical coupling element that can be coupled with a corresponding element on the filter housing thereby providing a simple electrical connection.

In summary, one feature of the invention resides broadly in a vacuum cleaner for vacuuming an object. The vacuum cleaner includes suction apparatus for withdrawing at least air from the vicinity of the object to be vacuumed. Also included is filter apparatus for filtering at least the air withdrawn by the suction apparatus from the vicinity of the object to be vacuumed. Further, connector apparatus is provided for connecting the suction apparatus to the filter apparatus. The connector apparatus includes a rigid housing wherein the rigid housing includes attachment apparatus for attaching the rigid housing to the filter apparatus and the suction apparatus, the rigid housing defines first channel apparatus connected between the filter apparatus and the suction apparatus for channelling at least the air withdrawn from the vicinity of the object to be vacuumed from the suction apparatus to the filter apparatus and the rigid housing defines second channel apparatus connected to the filter apparatus for channelling at least filtered air away from the filter apparatus.

Another feature of the invention resides broadly in a connector for connecting the filter device of a vacuum cleaner to the suction device of the vacuum cleaner. The connector includes a rigid housing, wherein the rigid housing includes attachment apparatus for attaching the rigid housing to the filter device and to the suction device. The rigid housing defines first channel apparatus for being connected between the filter device and the suction device for channelling at least air from the suction device to the filter device and the rigid housing defines second channel apparatus for being connected to the filter device for channelling at least air away from the filter device.

BRIEF DESCRIPTION OF THE DRAWINGS

The present invention may be better understood when taken in conjunction with the appended drawings in which.

DESCRIPTION OF THE PREFERRED EMBODIMENT

Figure 1:
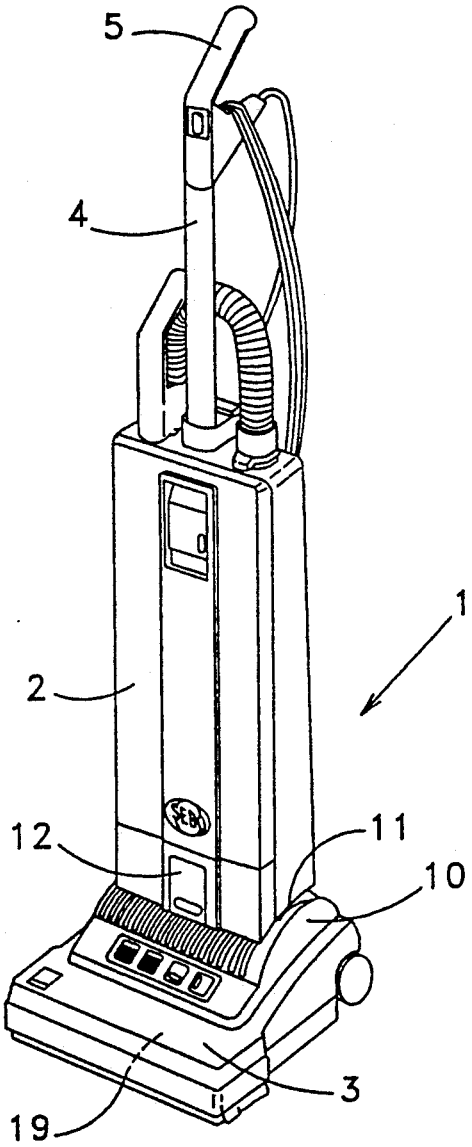
FIG. 1 is a perspective view of a brush-type vacuum cleaner of the present invention.
Figure 2:
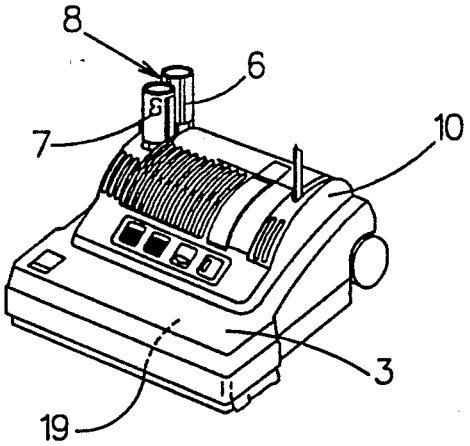
FIG. 2 is a perspective view of the brush-suction head of the vacuum cleaner of FIG. 1 and the guide element of the present invention.
Figure 3:
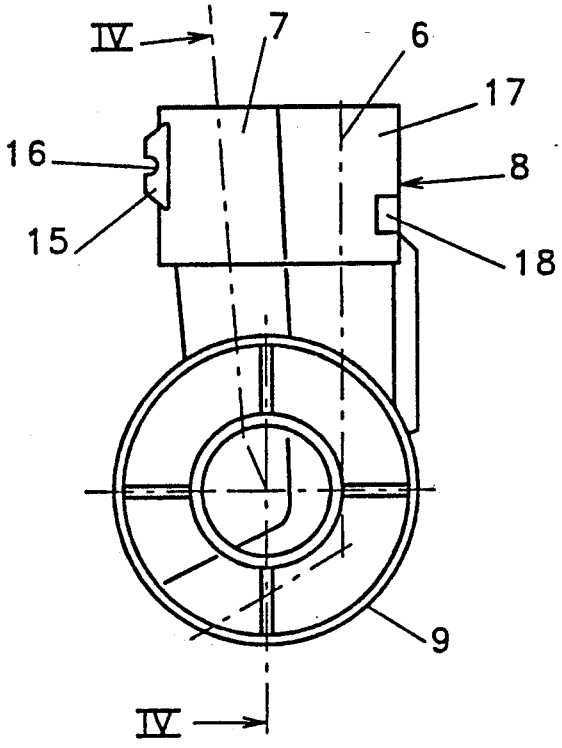
FIG. 3 is a side elevational view of the guide element of the vacuum cleaner of FIG. 1.
Figure 4:
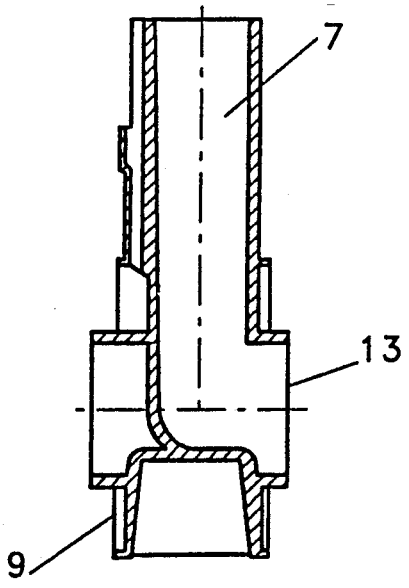
FIG. 4 is a cross sectional view of the guide element of FIG. 3, taken along line IV—IV of FIG. 3.
Figure 5:
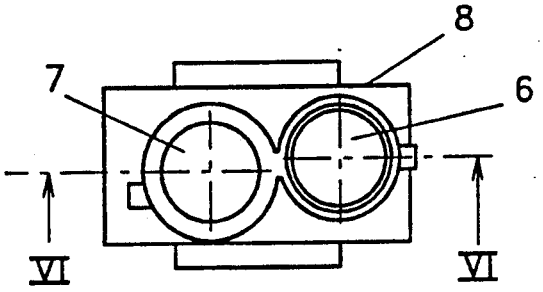
FIG. 5 is a top view of the guide elements of FIG. 3.
Figure 6:
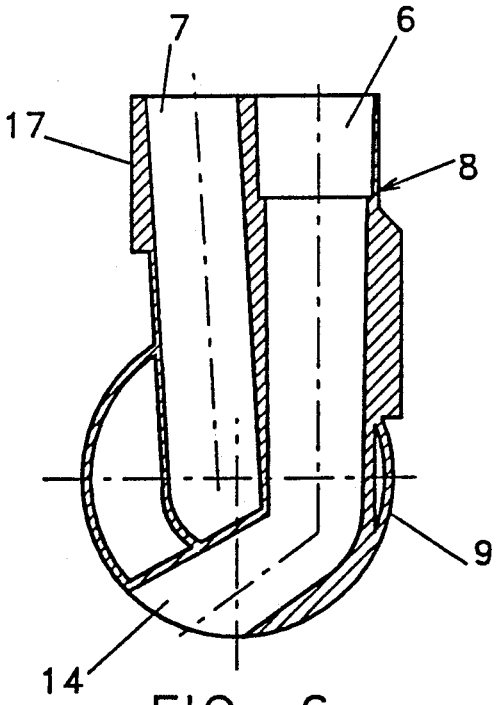
FIG. 6 is a cross sectional view of the guide element of FIG. 3, taken along line VI—VI of FIG. 5.

FIGS. 1–6 show brush-type vacuum cleaner 1 as well as the individual elements comprising vacuum cleaner 1. Vacuum cleaner 1 includes filter housing 2 and brush-suction head 3. Brush-suction head 3 may be replaced by a non-brush type suction head. Filter housing 2 is equipped with a handle comprising shaft 4 and grip 5. Filter housing 2 may also include an air filter such as a filter bag. Brush-suction head 3 includes a motor that drives the suction blower and, also, simultaneously drives a cleaning brush by means of drive belts. Such filter bags, motors, cleaning brushes and drive belts are well known in the art. Filter housing 2 and brush-suction head 3 are connected to one another by means of a pivoting connection such as connector, or guide element, 8.

With brush-type vacuum cleaner 1, the suction air generated may travel from the vacuum mouthpiece of brush-suction head 3 and into filter housing 2 via channel 6. Channel 6 may act as an inlet line for the dirt-laden suction air. From filter housing 2, the air may travel via channel 7, wherein channel 7 may be parallel to channel 6, and back to brush-suction head 3.

Brush-suction head 3 is equipped with attachment, or guide element or connector, 8 that facilitates the pivoting of filter housing 2 with brush-suction head 3. Guide element, or connector, 8 has a guide cylinder, or guide surface, 9 and is mounted so that it can pivot in brush-suction head 3 such as in a corresponding receptacle that may form a part of brush-suction head 3. Attachment element, or guide element or connector, 8 contains outward-leading channels 6 and 7, wherein channels 6 and 7 may be parallel to one another. The ends of channels 6 and 7 form attachment 17 for the mounting of filter housing 2 with coordinated continuing channels in filter housing 2 and/or brush-suction head 3. Guide cylinder 9 may form an attachment for attaching, or guide element or connector, 8 to brush-suction head 3.

Brush-suction head 3 is equipped in the connection area with diagonally running guide 10 which is alignable with a corresponding receptacle 11 of filter housing 2. Guide 10 may define a curved surface or a partially circular surface. The connection area on attachment, or guide element or connector, 8 includes molded web 15 with notch 16 in which a locking element of filter housing 2 latches and that can be released by a corresponding release button 12 on filter housing 2.

A possible location for the releasable connection of an electrical lead from filter housing 2 to brush-suction head 3 is the vicinity adjacent attachment, or guide element or connector, 8 such as by, for example, electrical connector 18. Connector 18 may be a standard and well known type of electrical connector.

In the vicinity of brush-suction head 3 and inside attachment, or guide element or connector, 8, channel 7 is connected along an axis of guide cylinder 9 by opening 13 with the suction blower. Channel 6 is connected by means of opening 14, along an axis of channel 6, in the jacket surface of guide cylinder 9 with vacuum mouthpiece 19 of brush-suction head 3.

By means of this double channel connection between filter housing 2 and brush-suction head 3, a mechanical coupling is created which also ensures a separate air conduction independent of the pivot position.

While the present invention has been disclosed with respect to a brush type vacuum cleaner, it is to be understood that the present invention is equally usable in non-brush type vacuum cleaners, also.

In summary, one feature of the invention resides broadly in an apparatus for a brush-type vacuum cleaner for creation of a pivoting connection by means of a guide element between a filter housing with a handle and a brush-suction head mounted on the floor with a motor for a suction blower as well as for the drive of a cleaning brush, characterized by the fact that the guide element 8 has an air duct with two separate channels 6 and 7 and one end is designed as an attachment element 17 in the form of a connection above the brush-suction head 3 for mounting the filter housing 2 and the other end is designed as a circular element 9, which is guided so that it can pivot in the brush section head 3, and has an opening 13 in the vicinity of the axis from one channel 7 to the suction blower as well as an opening 14 of the other channel 6 in the outer surface of the guide element 8 for connection with a vacuum mouthpiece of the brush-suction head.

Another feature of the invention resides broadly in an apparatus characterized by the fact that the separate channels 6 and 7 are oriented approximately parallel.

Yet another feature of the invention resides broadly in an apparatus characterized by the fact that the attachment element 8 on the brush-suction head 3 has a receptacle for a locking element with the mountable filter housing 2.

Still yet another feature of the invention resides broadly in an apparatus characterized by the fact that the attachment or guide element 8 on the brush-suction head 3 bears an electric coupling element which can be coupled with a corresponding element on the filter housing 2.

Examples of vacuum cleaners and related devices may be found in now allowed U.S. patent application Ser. No. 07/466,038 entitled "A Floor Cleaning Machine" and U.S. Pat. Nos. 4,418,342 entitled "Method of and a Circuit for Indicating the Optimum Adjustment of the Working Position of a Brush Roller in an Electrically Operated Floor Cleaning Appliance"; 4,910,824 entitled "Floor Polisher"; 4,679,271 entitled "Automatic Tool Force Compensator for a Surface Maintenance Machine"; 4,955,106 entitled "Upright Vacuum Cleaner"; 4,699,641 entitled "Support Tray for Disposable Filter Bag", 4,262,384 entitled "Vacuum Cleaner Bag Assembly"; 4,452,618 entitled "Suction Cleaners With a Bag Transfer Arrangement"; and 4,705,547 entitled "Dirt Drawer Latch for Vacuum Cleaner" and 5,028,245 entitled "Vacuum Cleaner Including Filter Bag Mounting Apparatus".

All, or substantially all, of the components and methods of the various embodiments may be used with at least one embodiment or all of the embodiments, if any, described herein.

All of the patents, patent applications and publications recited herein, if any, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The invention as described hereinabove in the context of the preferred embodiment is not to be taken as limited to all of the provided details thereof, since modifications and variations thereof may be made without departing from the spirit and scope of the invention.

What is claimed is:

1. A connector for connecting a filter device of a vacuum cleaner to a suction head of the vacuum cleaner, said connector comprising:

a single, integral piece, said single integral piece comprising;

a rigid housing, said rigid housing having a first portion and a second portion, said first portion configured for being attached to the filter device and said second portion configured for being attached to the suction head;

said first portion of said rigid housing including means for attaching said rigid housing to the filter device;

said second portion of said rigid housing comprising means for pivotally connecting said rigid housing to the suction head, said means for pivotally connecting comprising a circular guide cylinder configured for being guided to pivot in a suction head of a vacuum cleaner;

said rigid housing defining a first channel configured for being connected between the filter device and the suction head, said first channel configured for channelling at least dirty air from the suction head to the filter device;

said rigid housing defining a second channel configured for being connected to the filter device and communicating the filter device and a suction device disposed within the suction head, said second channel configured for channelling at least filtered air away from the filter device to the suction device;

said first channel and said second channel each define a longitudinal axis, said first channel longitudinal axis being substantially parallel to said second channel longitudinal axis;

said circular guide cylinder comprises an exterior guide surface defined by said rigid housing, said guide surface being configured for guidingly pivoting said connector within the suction head;

said circular guide cylinder has a longitudinal axis;

said first channel longitudinal axis and said second channel longitudinal axis are substantially perpendicular to said longitudinal axis of said circular guide cylinder;

said first channel includes a first channel portion adjacent the second portion of the rigid housing, said first channel portion defining an axle, said first channel portion axis diverging from said first channel longitudinal axis to form an obtuse angle with said first channel longitudinal axis;

said second channel includes a second channel portion adjacent the second portion of the rigid housing, said second channel portion defining an axis, said second channel portion axis diverging from said second channel longitudinal axis in a substantially perpendicular direction to said second channel longitudinal axis;

said first channel portion axis diverges from said second channel portion axis in a substantially perpendicular direction;

said first channel portion comprises an opening in said exterior guide surface, said first channel comprising a channel extending from said first portion of said rigid housing to said opening in said exterior guide surface; and said second channel portion comprises an opening, said second channel portion opening being concentric to said exterior guide surface and disposed within said exterior guide surface, said second channel comprising a channel extending from said first portion of said rigid housing to said opening concentric within said exterior guide surface.

2. The connector according to claim 1, wherein:

said opening of said first channel portion in said exterior guide surface is configured for being connected to a vacuum mouthpiece of the suction head for sucking dirt; and said opening of said second channel portion is configured for being connected to the suction device in the suction head for providing vacuum to the filter device.

3. The connector according to claim 2, wherein said rigid housing has a front portion for being disposed towards a front of the suction head, and a rear portion for being disposed towards a rear of the suction head;

said rigid housing being pivotable in a direction aligned with said front portion and said rear portion;

said first channel and said second channel being disposed substantially aligned from said front portion to said rear portion of said rigid housing; and said second channel portion being disposed forward of said first channel portion.

4. The connector according to claim 3, wherein said attachment means comprises a projection disposed on said first portion of said rigid housing, said projection comprising means for releasably receiving a locking element of the filter device.

5. The connector according to claim 4, wherein said means for releasably receiving is a slot in said attachment means.

6. The connector according to claim 5, further comprising cylindrical flanges extending from side portions of the rigid housing, said cylindrical flanges being substantially concentric within said circular guide cylinder; and one of said cylindrical flanges extending from said side portions comprising said opening of said second channel.

7. A connector for connecting a filter device of a vacuum cleaner to a suction head of a vacuum cleaner, said connector comprising a single, integral piece and said single integral piece comprising:

a rigid housing, said rigid housing having a first portion and a second portion, said first portion configured for being attached to the filter device and said second portion configured for being attached to the suction head;

said rigid housing has a front portion configured for being disposed towards a front of the suction head, and a rear portion configured for being disposed towards a rear of the suction head;

said first portion of said rigid housing including means for attaching said rigid housing to the filter device;

said second portion of said rigid housing comprising means for pivotally connecting said rigid housing to the suction head, said means for pivotally connecting comprising a circular guide cylinder configured for being guided to pivot in the suction head of the vacuum cleaner, said circular guide cylinder having a cylindrical exterior guide surface configured for guiding pivoting of said connector within the suction head;

said rigid housing configured for being pivotable in a direction aligned with said front portion and said rear portion;

said rigid housing defining a first channel configured for being connected between the filter device and the suction head, said first channel configured for channelling at least air from the suction head to the filter device;

said rigid housing defining a second channel configured for communicating the filter device and a suction device disposed within the suction head, said second channel configured for channelling at least filtered air away from the filter device to the suction device;

said first channel and said second channel each defining a longitudinal axis;

said first channel longitudinal axis being substantially parallel to said second channel longitudinal axis;

said circular guide cylinder defining a longitudinal axis;

said first channel longitudinal axis and said second channel longitudinal axis being substantially perpendicular to said longitudinal axis of said circular guide cylinder;

said first channel and said second channel being disposed substantially aligned from said front portion to said rear portion of said rigid housing;

said second channel being disposed forward of said first channel;

said first channel including a first channel portion adjacent the second portion of the rigid housing;

said first channel portion defining an axis;

said first channel portion axis diverging from said first channel longitudinal axis to form an obtuse angle with said first channel longitudinal axis;

said second channel including a second channel portion adjacent the second portion of the rigid housing;

said second channel portion defining an axis;

said second channel portion axle diverging from said second channel longitudinal axis in a substantially transverse direction to said second channel longitudinal axis;

said first channel portion axis diverging from said second channel portion axis in a substantially transverse direction;

said first channel portion comprising an opening in a bottom of said cylindrical exterior guide surface, said first channel comprising a channel extending from said first portion of said rigid housing to said opening in said bottom of said exterior guide surface; and said second channel portion comprises an opening, said opening of said second channel portion being disposed within said exterior guide surface, and concentric to said exterior guide surface, said second channel comprising a channel extending from said first portion of said rigid housing to said opening concentric within said exterior guide surface;

said opening of said first channel portion in said exterior guide surface configured for being connected to a vacuum mouthpiece of the suction head for sucking dirt; and said opening of said second channel configured for being connected to the suction device in the suction head for providing vacuum to the filter device.

8. The connector according to claim 7, wherein:

said attachment means comprises a projection disposed on said first portion of said rigid housing, said projection comprising means for releasably receiving a locking element of a filter device, said means for releasably receiving being a slot in said attachment means;

said connector further comprises cylindrical flanges extending from the side portion of the rigid housing, said cylindrical flanges being substantially concentric within said circular guide cylinder; and one of said cylindrical flanges extending from said side portions comprising said opening of said second channel.

* * * * *

UNITED STATES PATENT AND TRADEMARK OFFICE

CERTIFICATE OF CORRECTION

PATENT NO. : 5,228,169

DATED : July 20, 1993

INVENTOR(S) : Klaus STEIN and Heinz KAULIG

It is certified that error appears in the above-identified patent and that said Letters Patent is hereby corrected as shown below:

In column 3, line 39, after 'attaching', delete ", or".

In column 7, line 40, after 'portion', delete "axle" and insert --axis--.

In column 8, line 35, after 'from', delete "the side portion" and insert --side portions--.

Signed and Sealed this

Nineteenth Day of April, 1994

*Attest:*

*Attesting Officer*

Bruce Lehman

BRUCE LEHMAN

*Commissioner of Patents and Trademarks*